US007921835B2

(12) United States Patent
Campo et al.

(10) Patent No.: US 7,921,835 B2
(45) Date of Patent: Apr. 12, 2011

(54) WIRELESS PROJECTILE LOADER SYSTEM

(75) Inventors: John Campo, Medford, NJ (US); Louis Spicer, Sewell, NJ (US)

(73) Assignee: Kee Action Sports I LLC, Sewell, NJ (US)

( * ) Notice: Subject to any disclaimer, the term of this patent is extended or adjusted under 35 U.S.C. 154(b) by 639 days.

(21) Appl. No.: 11/522,071

(22) Filed: Sep. 15, 2006

(65) Prior Publication Data

US 2010/0258101 A1 Oct. 14, 2010

Related U.S. Application Data

(60) Provisional application No. 60/717,449, filed on Sep. 15, 2005.

(51) Int. Cl.
*F41B 11/02* (2006.01)

(52) U.S. Cl. ..... 124/51.1

(58) Field of Classification Search ..... 124/51.1, 124/73, 74

See application file for complete search history.

(56) References Cited

U.S. PATENT DOCUMENTS

| | | | |
|---|---|---|---|
| 1,403,689 | A | 1/1922 | Hyndman |
| 1,403,719 | A | 1/1922 | Szepe |
| 1,404,689 | A | 1/1922 | Fairweather |
| 1,743,576 | A | 1/1930 | Bigham |
| 1,867,513 | A | 7/1932 | Johannes |
| 2,307,015 | A | 1/1943 | Boynton |
| 2,357,951 | A | 9/1944 | Hale |
| 2,398,263 | A | 4/1946 | Trimbach |
| 3,248,008 | A | 4/1966 | Meierjohan |
| 3,467,073 | A | 9/1969 | Rhodes |
| 3,610,223 | A | 10/1971 | Green |
| 3,695,246 | A | 10/1972 | Filippi et al. |
| 3,788,298 | A | 1/1974 | Hale |
| 3,844,267 | A | 10/1974 | Mohr |
| 3,855,988 | A | 12/1974 | Sweeton |
| 3,867,921 | A | 2/1975 | Politzer |
| 4,027,646 | A | 6/1977 | Sweeton |
| 4,185,824 | A | 1/1980 | Natwick |
| 4,207,857 | A | 6/1980 | Balka, Jr. |

(Continued)

FOREIGN PATENT DOCUMENTS

| | | |
|---|---|---|
| DE | 876370 | 5/1953 |

(Continued)

OTHER PUBLICATIONS

WARPIG—World And Regional Paintball Information Guide, http://www.warpig.com/paintball/technical/loaders/halo/index.shtml, warpig.com, Odyssey Readies Halo for Production, By Bill Mills, Jun. 2001, pp. 1 to 5.

(Continued)

*Primary Examiner* — John Ricci
(74) *Attorney, Agent, or Firm* — Volpe and Koenig, P.C.

(57) ABSTRACT

A wireless projectile loader system is provided. The system includes at least one sensor for detecting a firing operation of a compressed gas gun and sending a signal to a wireless transmitter. The system further includes a wireless transmitter in communication with the at least one sensor, the wireless transmitter adapted to send a wireless signal in response to the sensor detecting a firing operation. The system further includes at least one wireless receiver for receiving the wireless signal in communication with a motor of a projectile loader and adapted to operate the motor in response to the signal transmitted by the transmitter.

16 Claims, 13 Drawing Sheets

U.S. PATENT DOCUMENTS 4,332,097 A 6/1982 Taylor, Jr.
4,396,193 A 8/1983 Reinhardt et al.
4,502,455 A 3/1985 Stokes
4,646,709 A 3/1987 Kholin
4,819,609 A 4/1989 Tippmann
4,896,646 A 1/1990 Kahelin et al.
4,923,066 A 5/1990 Ophir et al.
4,926,742 A 5/1990 Ma et al.
4,930,400 A 6/1990 Brandl et al.
4,936,282 A 6/1990 Dobbins et al.
4,951,548 A 8/1990 Wixon et al.
4,951,644 A 8/1990 Bon
4,965,951 A 10/1990 Miller et al.
4,986,251 A 1/1991 Lilley
4,993,400 A 2/1991 Fitzwater
5,063,905 A 11/1991 Farrell
5,097,816 A 3/1992 Miller
5,097,985 A 3/1992 Jones
5,166,457 A 11/1992 Lorenzetti
5,233,125 A 8/1993 Bouver et al.
5,251,906 A 10/1993 Heller et al.
5,282,454 A 2/1994 Bell et al.
5,322,283 A 6/1994 Ritchie et al.
5,335,579 A 8/1994 David
5,353,712 A 10/1994 Olson
5,383,442 A 1/1995 Tippmann
5,456,153 A 10/1995 Bentley et al.
5,490,493 A 2/1996 Salansky
5,497,758 A 3/1996 Dobbins et al.
5,505,188 A 4/1996 Williams
5,511,333 A 4/1996 Farrell
5,520,171 A 5/1996 David
5,542,570 A 8/1996 Nottingham et al.
5,561,258 A 10/1996 Bentley et al.
5,600,083 A 2/1997 Bentley et al.
5,722,383 A 3/1998 Tippmann
5,727,538 A 3/1998 Ellis
5,736,720 A 4/1998 Bell et al.
5,749,797 A 5/1998 Sunseri et al.
5,771,875 A 6/1998 Sullivan
5,784,985 A 7/1998 Lodico et al.
5,791,325 A 8/1998 Anderson
5,794,606 A 8/1998 Deak
5,809,983 A 9/1998 Stoneking
5,816,232 A 10/1998 Bell
5,836,583 A 11/1998 Towers
5,839,422 A 11/1998 Ferris
5,881,962 A 3/1999 Schmidt et al.
5,887,578 A 3/1999 Backeris et al.
5,947,100 A 9/1999 Anderson
5,954,042 A 9/1999 Harvey
6,032,395 A 3/2000 Bentley et al.
6,055,975 A 5/2000 Gallagher et al.
6,062,208 A 5/2000 Seefeldt et al.
6,083,105 A 7/2000 Ronin et al.
6,109,252 A 8/2000 Stevens
6,206,562 B1 3/2001 Eyraud et al.
6,213,110 B1 4/2001 Christopher et al.
6,220,237 B1 4/2001 Johnson et al.
6,305,367 B1 10/2001 Kotsiopoulos
6,311,682 B1 11/2001 Rice et al.
6,327,953 B1 12/2001 Andresen
6,347,621 B1 2/2002 Guthrie
6,374,819 B1 4/2002 Ming-Hsien
6,408,837 B1 6/2002 Johnson et al.
D459,767 S 7/2002 Rushton
6,415,781 B1 7/2002 Perrone
6,418,919 B1 7/2002 Perrone
6,425,781 B1 7/2002 Bernstein et al.
6,460,530 B1 10/2002 Backeris et al.
6,467,473 B1 10/2002 Kotsiopoulos
6,468,879 B1 10/2002 Lamure et al.
6,481,432 B2 11/2002 Rushton et al.
6,488,019 B2 12/2002 Kotsiopoulos
6,502,567 B1 1/2003 Christopher et al.
6,520,854 B1 2/2003 McNally
6,526,955 B1 3/2003 Juan
6,591,824 B2 7/2003 Hatcher
6,609,511 B2 8/2003 Kotsiopoulos
6,615,814 B1 9/2003 Rice et al.
6,644,293 B2 11/2003 Jong
6,684,873 B1 2/2004 Anderson
6,701,907 B2 3/2004 Christopher et al.
6,708,685 B2 3/2004 Masse
6,725,852 B1 4/2004 Yokota
6,729,321 B2 5/2004 Ho
6,729,497 B2 5/2004 Rice et al.
6,739,322 B2 5/2004 Rice et al.
6,739,323 B2 5/2004 Tippmann, Jr.
6,742,512 B1 6/2004 Ho
6,748,938 B2 6/2004 Rice et al.
6,752,137 B2 6/2004 Brunette
6,792,933 B2 9/2004 Christopher et al.
6,802,306 B1 10/2004 Rice
6,860,258 B2 3/2005 Farrell
6,860,259 B2 3/2005 Rice et al.
6,889,680 B2 5/2005 Christopher et al.
6,899,328 B2 5/2005 Halliburton et al.
6,915,792 B1 7/2005 Sheng
6,941,693 B2 9/2005 Rice et al.
6,973,748 B2 12/2005 Rice
6,978,776 B2 12/2005 Hamilton
6,981,493 B1 1/2006 Poteracku
7,021,302 B2 4/2006 Neumaster
7,077,118 B2 7/2006 Lewis
7,159,585 B2 1/2007 Quinn et al.
7,222,617 B2 5/2007 Andresen
7,231,914 B2 6/2007 Hatcher
7,234,456 B2 6/2007 Andresen
7,270,121 B2 9/2007 Lubben
7,428,899 B2 9/2008 Andersen
7,770,569 B2 8/2010 Andresen
7,779,825 B2 8/2010 Estrate
2002/0059927 A1 5/2002 Woods
2002/0117159 A1 8/2002 Kotsiopoulos et al.
2003/0079731 A1 5/2003 Dobbins
2004/0074487 A1 4/2004 Christopher et al.
2004/0134475 A1 7/2004 Jong
2004/0211402 A1 10/2004 Christopher et al.
2005/0274370 A1 12/2005 Lubben
2005/0274371 A1* 12/2005 Lubben ..... 124/51.1
2006/0005823 A1 1/2006 Quinn
2006/0037597 A1 2/2006 Wood
2006/0086347 A1 4/2006 Hedberg
2006/0124118 A1 6/2006 Dobbins
2006/0249131 A1 11/2006 Broersma
2006/0254572 A1 11/2006 Hall
2007/0012304 A1* 1/2007 van Dorsser et al. ..... 124/51.1
2007/0017495 A1 1/2007 Andresen
2007/0101981 A1 5/2007 Chen
2007/0175463 A1* 8/2007 Higgins et al. ..... 124/45
2008/0047536 A1 2/2008 Chen
2009/0241929 A1 10/2009 Italia et al.

FOREIGN PATENT DOCUMENTS

DE 2035097 8/1982
DE 3721527 1/1989
DE 4343870 6/1994
DE 4343871 6/1995
DE 19922589 12/2000
EP 0075970 4/1983
EP 01054228 11/2000
EP 01653189 5/2006
FR 921527 5/1947
GB 470201 8/1937
GB 551077 2/1943
GB 2322438 8/1998
GB 2352022 5/2003
GB 2345953 7/2003
JP 1179898 7/1989
JP 6-325233 11/1994
JP 6325233 11/1994
TW M255391 1/2005
TW M261677 4/2005
TW M290989 5/2006
WO 98/13660 4/1998
WO 01/44745 6/2001

| | | |
|---|---|---|
| WO | 02/42708 | 5/2002 |
| WO | 03087698 | 10/2003 |
| WO | 2007/035601 | 3/2007 |
| WO | 2007033309 | 3/2007 |
| WO | 2007044546 | 4/2007 |
| WO | 2007044822 | 4/2007 |
| WO | 2007/098554 | 9/2007 |
| WO | 2008104061 | 4/2008 |

OTHER PUBLICATIONS

WARPIG—World and Regional Paintball Information Guide, http://www.warpig.com/paintball/technical/loaders/halo/review.shtml, warpig.com, Odyssey Halo By Bill Mills, Dec. 2001, pp. 1 to 7.

Odyssey Halo B Paintball Hopper Review, http://www.paintball-gun-review.com/hopper-reviews/odyssey-halo-b..., Paintball Gun Review, Odyssey Halo B Paintball Hopper Review, 2004 Paintball-Gun-Review.com, pp. 1 to 4.

www.Odysseypaintball.com, http://web.archive.org/web/20030205112543/http://www.odysseypain..., Odyssey Paintball Products, Understanding Halo B, pp. 1 to 3.

WARPIG—World And Regional Paintball Information Guide, http://www.warpig.com/paintball/technical/loaders/evlution/evlution...

eVLution 2 Sneak Preview, by Bill Mills, Aug. 2001, p. 1 to 4.

WARPIG—World And Regional Paintball Information Guide, http://www.warpig.com/paintball/technical/loaders/evlution/index.shtml Brass Eagle's eVLution Loader, by Bill Mills, Aug. 2000, pp. 1 to 7.

WARPIG—World And Regional Paintball Information Guide, http://www.warpig.com/paintball/technical/labs/revytimes/index/shtml Warpig Ballistic Labs Report: Revolution Response Times, by Bill Mills, copyright 1992-2010, pp. 1 to 4.

* cited by examiner

WIRELESS PROJECTILE LOADER SYSTEM

CROSS REFERENCE TO RELATED APPLICATION

This application claims the benefit of U.S. Provisional Application No. 60/717,449, filed on Sep. 15, 2005, which is incorporated herein by reference as if fully set forth.

FIELD OF THE INVENTION

The present invention relates to the field of compressed gas guns and projectile sport loaders (also called hoppers or magazines) for such guns, such as paintball sport guns and paintball sport loaders.

BACKGROUND

Paintball, a popular sport has developed over the years, which uses paintball markers (guns), which are guns utilizing compressed gas to fire projectiles. Some examples of paintball guns are those offered under the brand names 32 DEGREES™, EMPIRE™, DIABLO™, and INDIAN CREEK DESIGNS™, and others shown and described in U.S. Pat. Nos. 6,708,685, 4,936,282, 5,497,758, and U.S. application Ser. Nos. 11/183,548, 11/180,506, 11/150,002, 11/064,693, 10/313,465, 10/090,810, the entire contents of which are all incorporated fully herein by reference. Players use the paintball guns to shoot projectiles known as paintballs (projectiles and paintballs are used interchangeably herein). These paintballs are spherical, frangible projectiles normally having gelatin or starch-based shells filled with paint (coloring or dye). The shells break when impacting a target, allowing the paint within to splatter on the target. The sport of paintball is often played like capture the flag. A player is eliminated from the game when the player is hit by a paintball fired from an opposing player's marker. When the paintball hits a target such as a player, a mark or "splat" of paint is left on the player.

Paintball loaders (otherwise known as hoppers or magazines, and also referred to herein as "projectile loaders") sit atop the markers and feed projectiles into the marker. These projectile loaders (the terms "hopper," "magazine," and "loader" are used interchangeably herein) store projectiles, and have an outlet or exit tube (outfeed tube or neck). The outlet tube is connected to an inlet tube (or feed neck) of a paintball marker, which is in communication with the breech of the paintball marker. Thus, the loaders act to hold and feed paintball projectiles into the breech of a paintball marker, so that the projectiles can be fired from the marker.

Many loaders contain agitators or feed systems to mix, propel, or otherwise move projectiles in the loader. This mixing is performed by an impeller, projection, drive cone, agitator, paddle, arm, fin, carrier, or any other mechanism, such as those shown and described in U.S. Pat. Nos. 6,213,110, 6,502,567, 5,947,100, 5,791,325, 5,954,042, 6,109,252, 6,889,680, and 6,792,933, the entire contents of which are incorporated by reference herein. In a "gravity feed" or "agitating" loader, an agitator mixes projectiles so that no jams occur at the exit opening of the outlet tube. In a "force feed" or "active feed" paintball loader, the agitator (drive cone, carrier, paddle or any other force feed drive system) forces projectiles through the exit tube. Because it is desirable to eliminate as many opposing players as possible, paintball markers are capable of semi-automatic rapid fire. The paintball loaders act to hold a quantity of projectiles, and ensure proper feeding of the projectiles to the marker for firing.

Modern paintball loaders utilize projections, paddles, arms, carriers, drive cones, or other agitators to mix or advance paintballs. These agitators are operated by motors, which are usually electrical, and powered by a power source such as a battery.

Many modern paintball loaders are equipped with on board sensors such as mechanical sensors, pressure sensors, piezoelectric sensors, sound sensors, optical sensors, IR sensors, or other sensors to detect whether the agitator should operate, or whether a paintball should be fed into the paintball marker. These sensors are built into and/or attached to the paintball loaders. Generally, the sensors act to detect whether paintball are present and/or absent in the outfeed or exit tube of the loader, or whether a stack of paintballs in the outfeed or exit tube is moving. Accordingly, such paintball loaders with on-board sensors are designed to feed paintballs based upon detecting or sensing paintballs or paintball movement in or at the exit from the loader.

In addition, there is no way for a user of a paintball gun to easily control the operation of a paintball loader coupled to the paintball gun.

SUMMARY OF THE INVENTION

The present invention is directed to a wireless projectile loader system. The system includes at least one sensor for detecting a firing operation of a compressed gas gun and sending a signal to a wireless transmitter in communication with the at least one sensor. The wireless transmitter sends a wireless signal in response to the sensor detecting a firing operation. The system further includes at least one wireless receiver in communication with a motor and/or controller of a projectile loader which receives the wireless signal to operate the motor in response to the signal transmitted by the transmitter.

In another embodiment of the present invention, the present invention is directed to a wireless projectile loader system including a compressed gas gun comprising at least on sensor for detecting a firing operation of the compressed gas gun. The sensor is in communication with at least one wireless transmitter. The wireless transmitter is adapted to transmit a signal in response to the sensor sensing the firing operation. A projectile loader is provided comprising an agitator, a motor, and at least one wireless receiver in communication with the motor. The wireless receiver is adapted to receive the signal generated by the transmitter, and in response to the signal, operate the motor.

A method of wirelessly operating a projectile loader is also provided, and comprises the steps of: detecting a firing operation of a compressed gas gun; transmitting a demand signal in response to the firing operation; transmitting a loader operation signal in response to the demand signal; detecting the loader operation signal; and, operating the motor of a projectile loader.

The present invention is further directed to a wireless paintball loader operation parameter system. The system includes a paintball gun including a user-actuable and/or controllable controller in communication with a wireless transmitter. A user may select projectile loader operation parameters with the controller. The wireless transmitter sends a wireless signal in response to user-selected projectile loader operation parameters. The system further includes at least one wireless receiver in communication with a controller of a projectile loader which receives the wireless signal to control, operate, monitor or display the user-selected operation parameter.

A method of controlling operation of a projectile loader is also provided, and comprises the steps of: (a) selecting a projectile loader operation parameter; (b) wirelessly transmitting a signal representing the selected projectile loader operation parameter in response to the selection; (c) receiving the signal; and, (d) controlling the operation of the projectile loader in response to the signal.

DETAILED DESCRIPTION OF THE PREFERRED EMBODIMENT(S)

Figure 1:
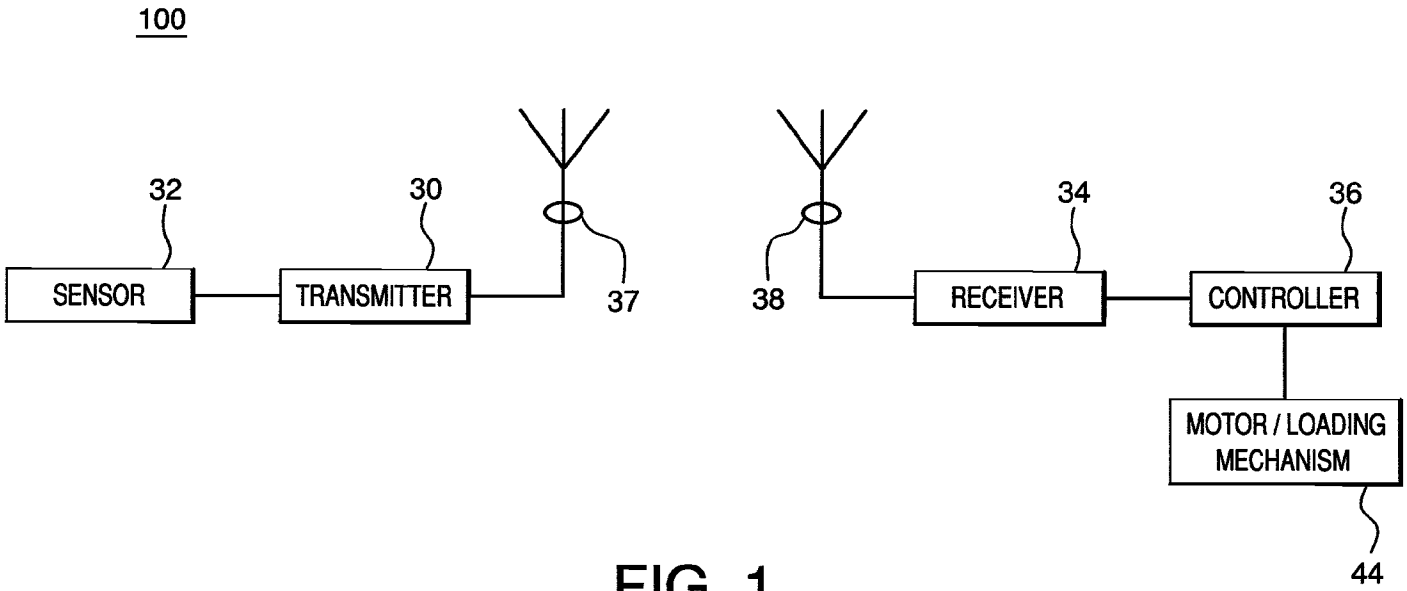
FIG. 1 is a functional block diagram of a wireless system configured to load a projectile, in accordance with the present invention.

Certain terminology is used in the following detailed description for convenience only and is not considered limiting. Several embodiments of the present wireless system of the present invention are disclosed here and in the Figures. The words "upper" and "lower" designate directions in the drawings to which reference is made. The words "forward" and "rear" or "rearward" designate directions in the drawings to which reference is made. Additionally, the terms "a" and "one" are defined as including one or more of the referenced item unless specifically noted.

FIGS. 3-6 show illustrative paintball guns 60 to which a paintball loader 10 according to the present invention may be attached. A paintball gun 60 (or any compressed gas gun for sport use) generally includes a gun body 62, a barrel 64, a grip portion 66, and a trigger 68. The paintball gun 60 also includes an inlet tube 22 (also called a feed neck) leading to an interior firing chamber 72 (or breech) in the interior of the main body 62. A compressed gas cylinder 70 is typically secured to a rear portion or bottom of the paintball gun 60. The compressed gas cylinder tank 70 normally contains $CO_2$ or $NO_2$, although any compressible gas may be used.

In most paintball guns 60, a bolt 74 is provided within the firing chamber or breech 72, that reciprocates by spring or pneumatic force to open and close an infeed opening 76, to allow paintballs to enter the breech 72 from the inlet tube 40, and then to chamber the paintballs 20 for firing. A valve 78 is used to regulate the supply of high pressure compressed gas through the gas passage in the bolt 74. Paintball guns utilize poppet valves, pin valves, spool valves, and other valving systems to supply compressed gas for firing a paintball gun. A hammer 82 is sometimes used to impact and open the valve 78. In other paintball gun arrangements, movement of the bolt 74 opens a flow passage, such as described in U.S. Pat. No. 6,708,685 rather than impacting a valve.

Figure 3:
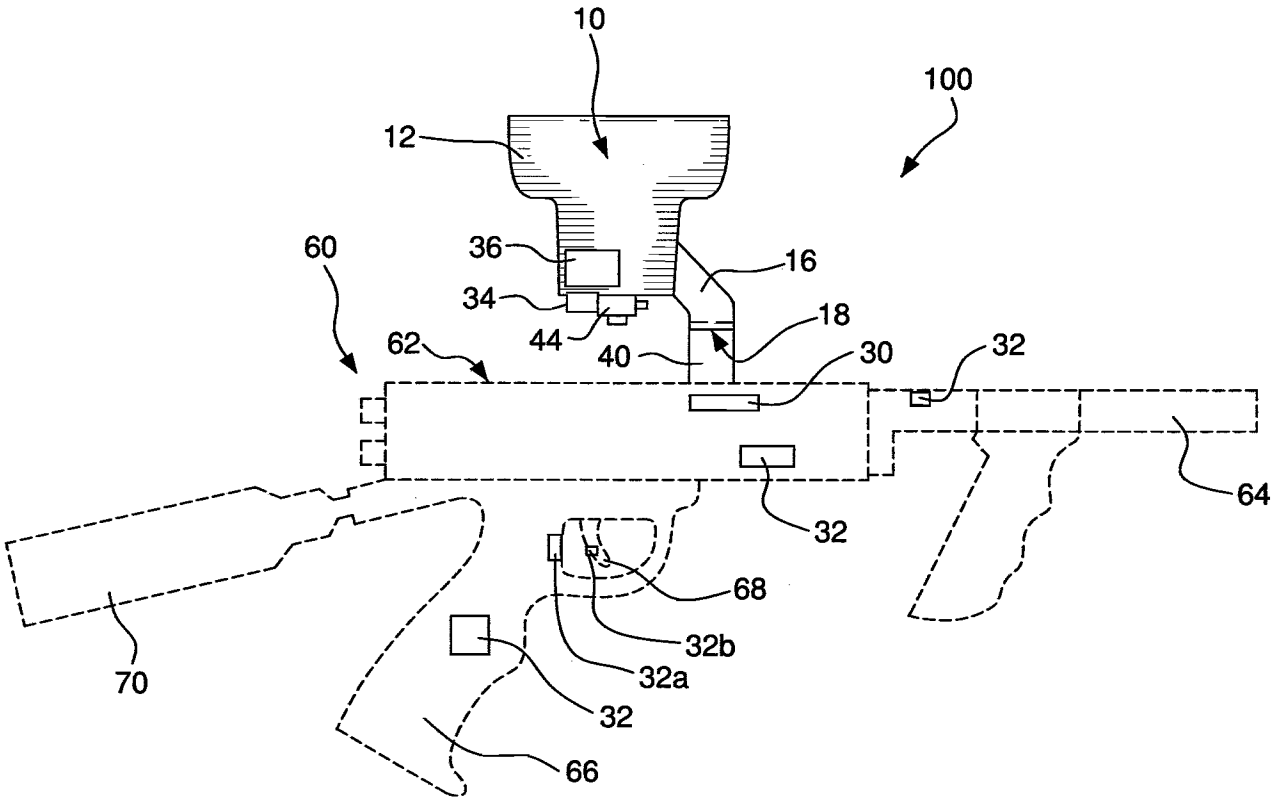
FIG. 3 illustrates an exemplary paintball loader according to the present invention sitting atop an illustrative paintball gun according to the present invention shown in phantom.
Figure 4:
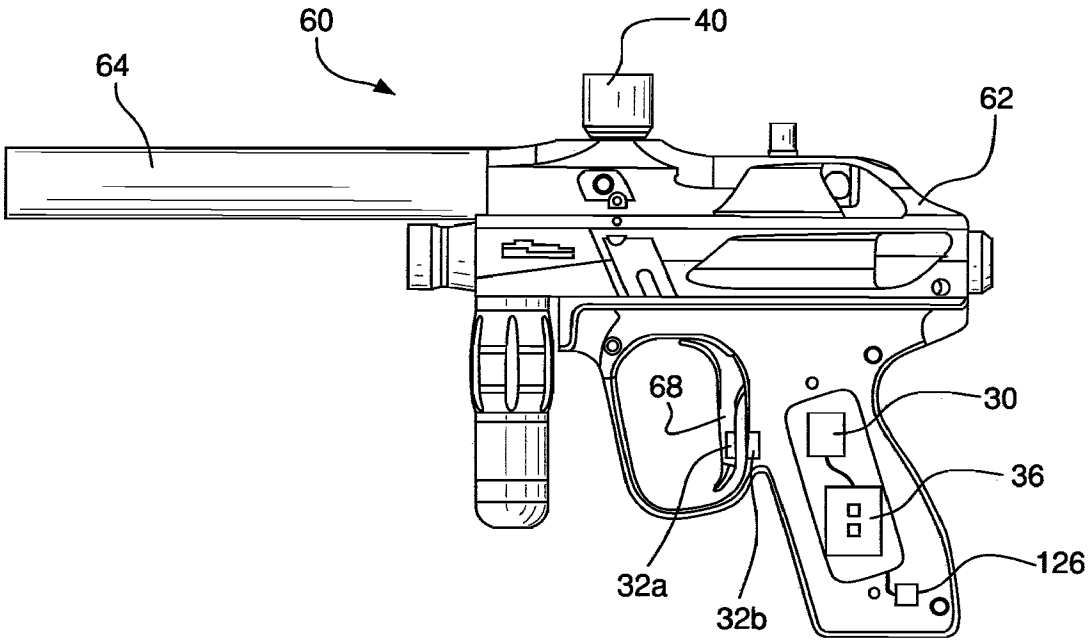
FIG. 4 shows a side view of an illustrative paintball gun according to the present invention.
Figure 5:
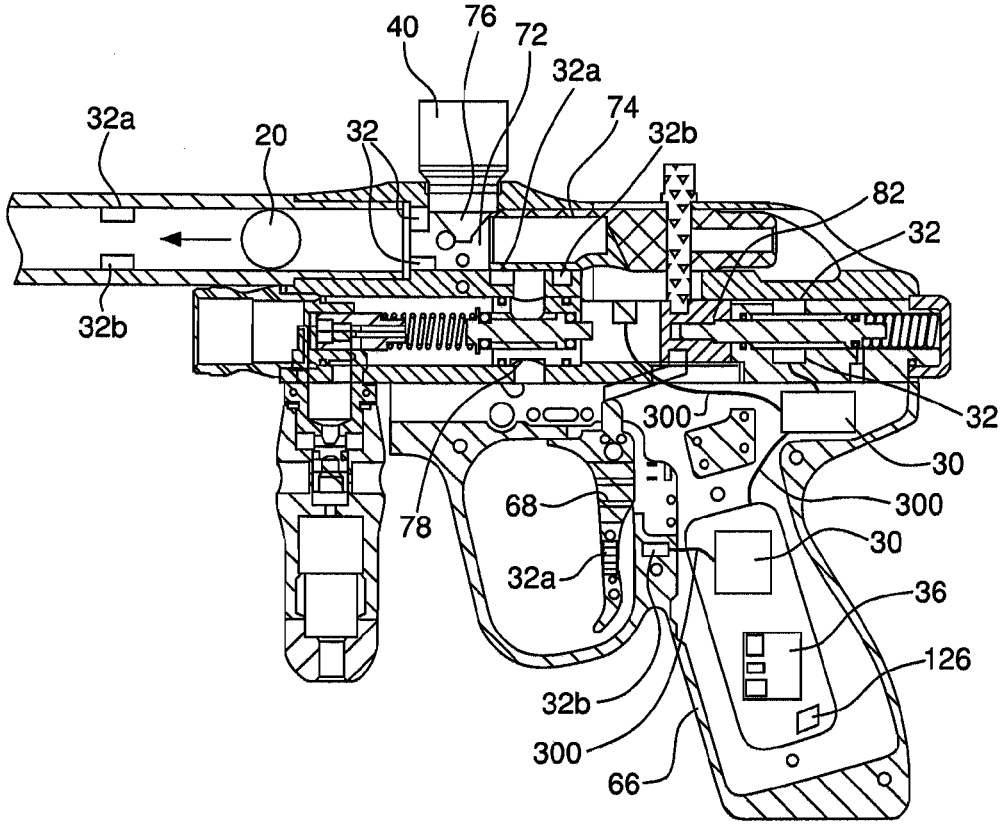
FIG. 5 shows a partial cross-sectional side view of the paintball gun shown in FIG. 4.
Figure 7:
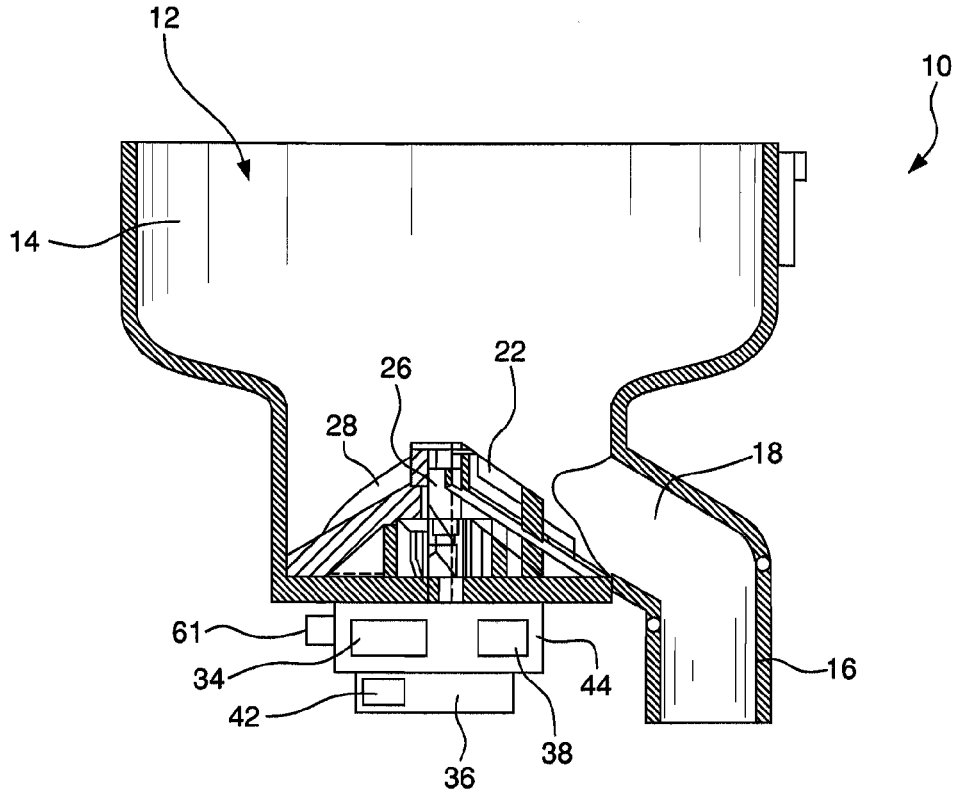
FIG. 7 shows a partial cross-sectional side view of an illustrative active or force feed paintball loader according to the present invention.
Figure 8:
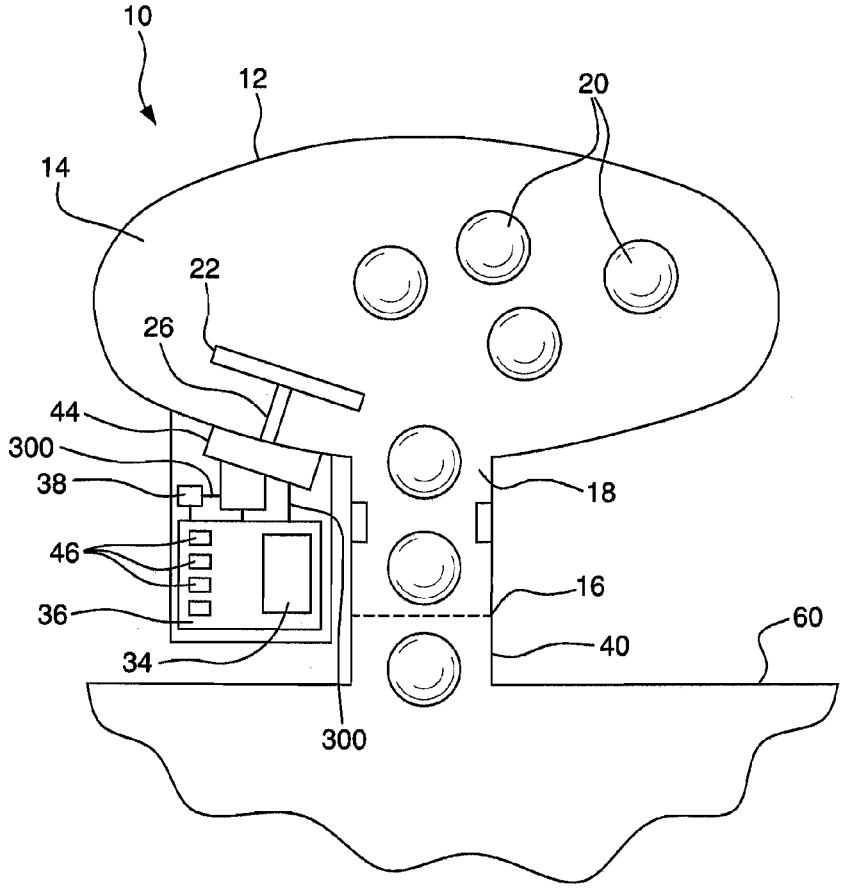
FIG. 8 shows a side partial interior cutaway view of an illustrative agitating paintball loader according to the present invention.
Figure 9:
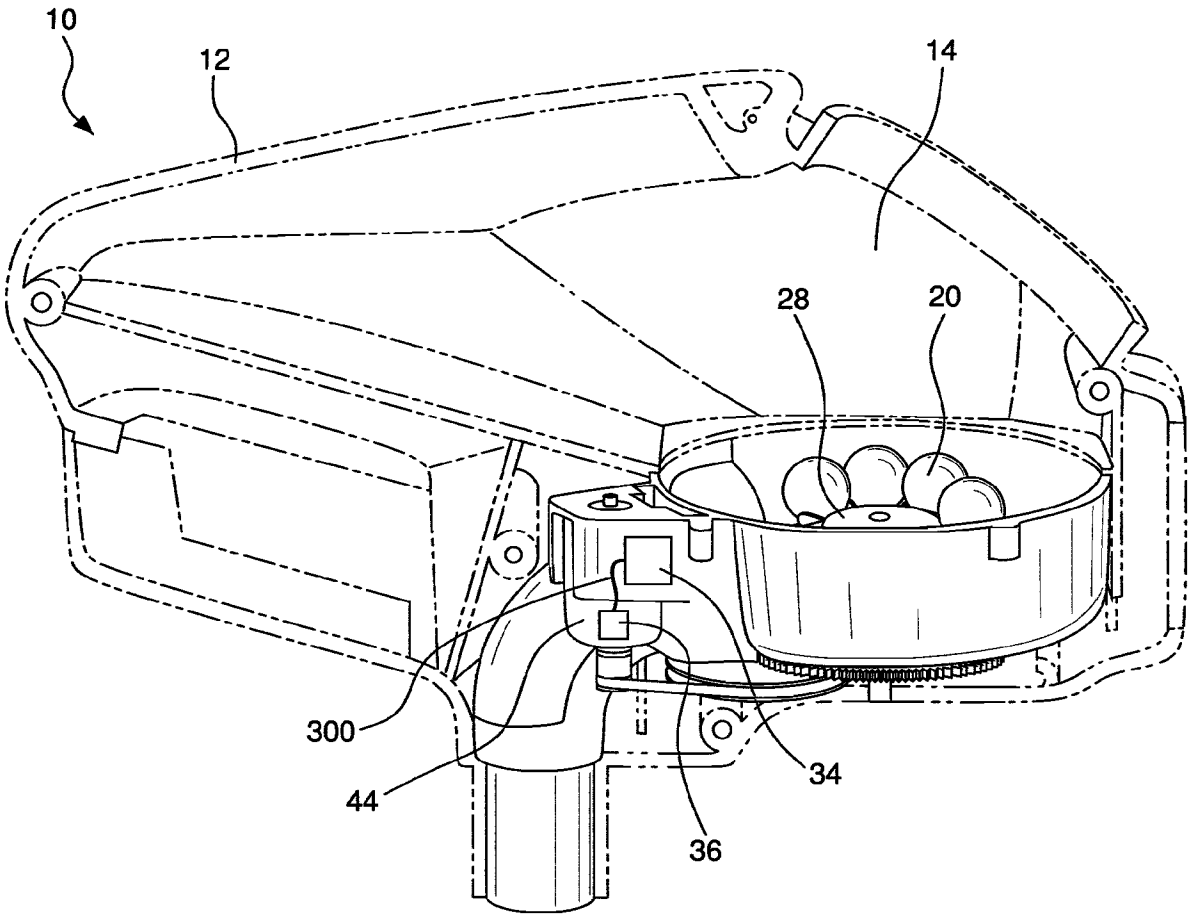
FIG. 9 shows a partial side sectional view of an active feed paintball loader according to the present invention.

Various paintball loaders 10 are shown in FIGS. 3, 7-9. A paintball loader 10 generally comprises a housing 12 forming an interior container area 14 for receiving paintballs 20. FIG. 8 shows a "gravity feed" or "agitating loading," while FIGS. 3, 7 and 9 show "active" or "force" feed loaders.

An exit opening 18 leads from a portion of the loader housing 12, usually the bottom, to an outfeed tube 16. The outfeed tube 16 extends from the exit opening 18, and is positioned to feed paintballs to the inlet tube 40 or breech 42 of a paintball gun 60. An agitator 22 is positioned at a location in the housing 12, usually adjacent the bottom portion. The agitator 22 includes at least one projection 24, extending from a drive shaft 26 coupled to a motor 44. The motor 44 coupled to the agitator 22 can be considered collectively as the "loader mechanism" of the paintball loader 10. Activation of the motor 44 rotates or otherwise operates or moves the drive shaft 26, and thus moves the agitator 22. In a gravity-feed loader, this will mix paintballs, to prevent jams for proper feeding. In an active (or force feed) paintball loader, paintballs will be forced by movement of the agitator 22 (which may be a feed mechanism 28 such as a drive cone) toward the exit opening 18, and into the outfeed tube 16. The paintball loader is connected to or mounted on a paintball gun 60, as shown generally in FIG. 3.

Figure 2:
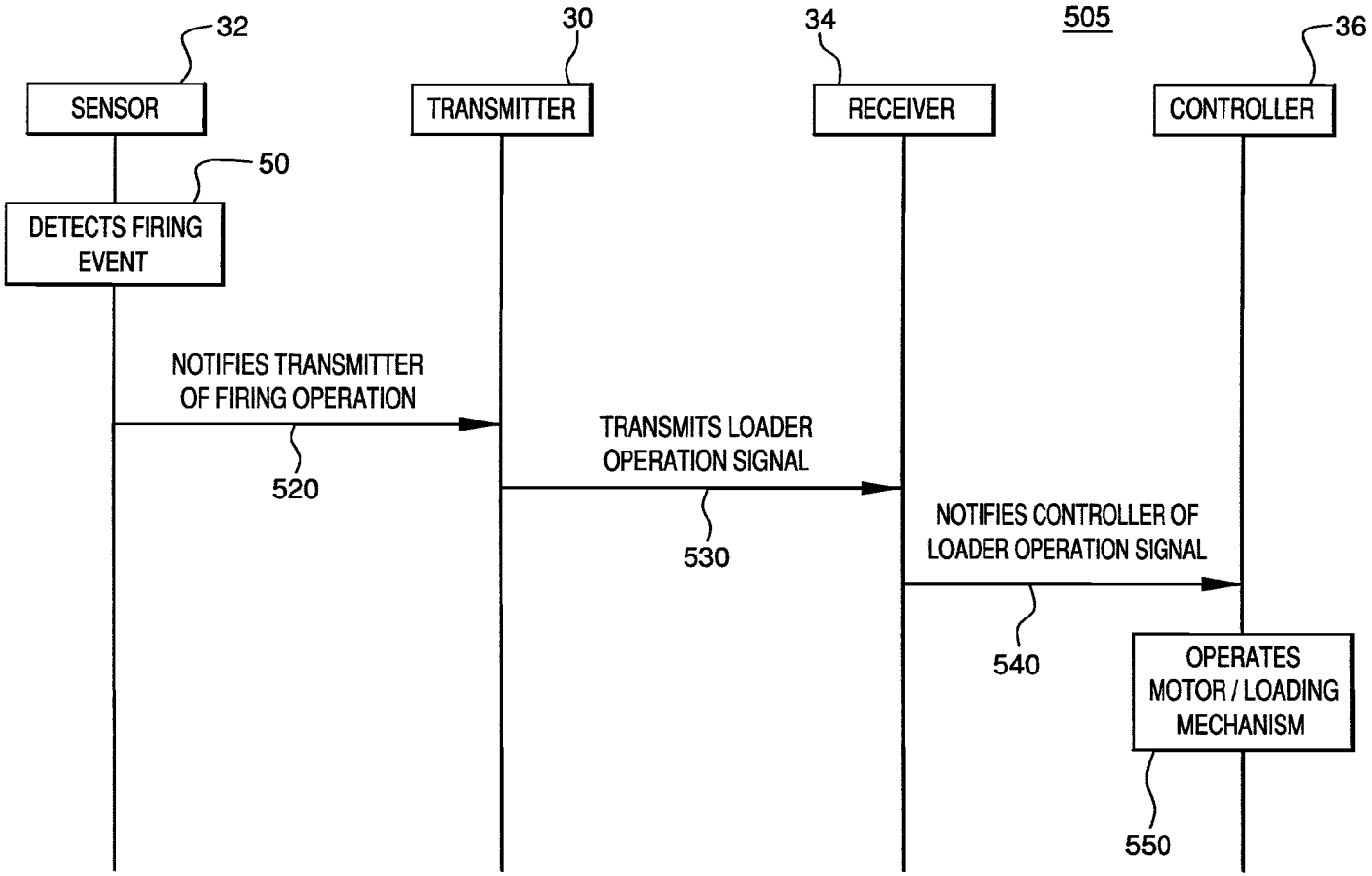
FIG. 2 is a signal diagram of a process for loading a projectile in accordance with the present invention.

The present invention is generally directed to an operation system for a paintball loader, where the paintball loader 10 is operated by a wireless communication system 100, as shown in FIGS. 1 and 2.

FIG. 1 is a functional block diagram of a wireless communication system 100 configured to initiate feeding of a projectile to the gun 60 based on a detected demand function (such as any time a paintball demands more paintballs for firing) such as a firing operation (firing event), in accordance with an embodiment of the present invention. On a transmission side, the wireless communication system 100 includes a sensor 32, a transmitter 30 in communication with the sensor 32, and an antenna 37 in communication with the transmitter 30 to facilitate the transmission of wireless information. On a receiving side, the wireless communication system includes a receiver 34, a controller 36 in communication with the receiver, and an antenna 38 in communication with the receiver 34 to facilitate the receiving of wireless information. The controller 36 is operatively connected to a motor 44 of a paintball loader 10 to operate the agitator 22 of the loader 10.

The sensor 32 may include a plurality of sensors located in a plurality of selected locations on the paintball gun 60 to detect a firing operation or related demand function, or may be a single sensor 32 located in a selected location on or within the paintball gun 60. In addition, the sensor 32 may include a variety of types of sensing devices. For example, the sensor 32 may include a magnetic sensor, optical sensor, piezoelectric sensor, positional sensor, sound sensor, electromechanical sensor, contact pad, pressure sensor, infrared sensor, LED sensor, and the like, or any combination thereof.

The sensor 32 may be an integral or separate part of the transmitter 30. The wireless transmitter 30 is a transmitter for transmitting a wireless transmission or signal, such as, for example, a radio frequency (RF) signal, microwaves, an infrared (IR) signal, or any other wireless signal. Additionally, the transmitter 30 may be any variety of wireless transmitters, such as a Bluetooth, or IEEE (Institute of Electrical and Electronic Engineers) 802.11 type transmitters.

The receiver 34 may be positioned on, adjacent or about the housing of the paintball loader 10, as shown in FIGS. 3 and 7-9. The receiver 34 for receiving the wireless signal is in communication with the loading mechanism 44 of the paintball loader 10, preferably through the controller 36.

The controller 36, and any controllers described herein, may include any type of controller, such as a digital or analog circuit that is capable of controlling the loading mechanism 44. For example, the controller 36 may be a solenoid coupled to the loading mechanism 44 which, when activated, operates a switch which causes the loading mechanism 44 to operate. The controller 36, and any controllers described herein, may also include circuit boards, computer "chips" and/or microprocessors, and any electric and/or electronic circuitry necessary for controlling, operating, monitoring, transmitting, storing, receiving, etc., the various signals described herein or the information transmitted by such signals, as will be familiar to those in the art.

In a preferred embodiment of the present invention, a "firing operation" or "firing event" generally refers to any demand function actions occurring when any compressed gas gun such as a paintball gun 60 is fired. Generally, a paintball gun firing operation is initiated by a user pulling a trigger 68, which causes a bolt 73 to reciprocate and chamber a projectile 20, and a valve in the paintball gun to release compressed gas for firing a chambered projectile (paintball) from the gun. Examples of such guns were previously mentioned above. Certain paintball guns are sold under the brand names ICON™, INDIAN CREEK DESIGNS™, FREESTYLET™, 32 DEGREES™, INTIMIDATORT™ and DIABLO™, and are well known in the art. The present invention is designed to operate with any compressed gas gun and any loader, and in particular, those used in the sport of paintball.

Thus, a firing operation or firing event (both terms used interchangeably) may be a paintball marker 60 being fired, a paintball marker 60 completing a firing cycle, a paintball marker in the process of firing a projectile 20, or the trigger of a paintball gun trigger 49 has been pulled initiating firing of the gun. A firing operation may also be a paintball 20 moving within the paintball gun 60, the barrel 64 of the paintball gun 60, or the infeed tube 40, all of which are a result of the firing of the paintball gun 60.

Figure 6:
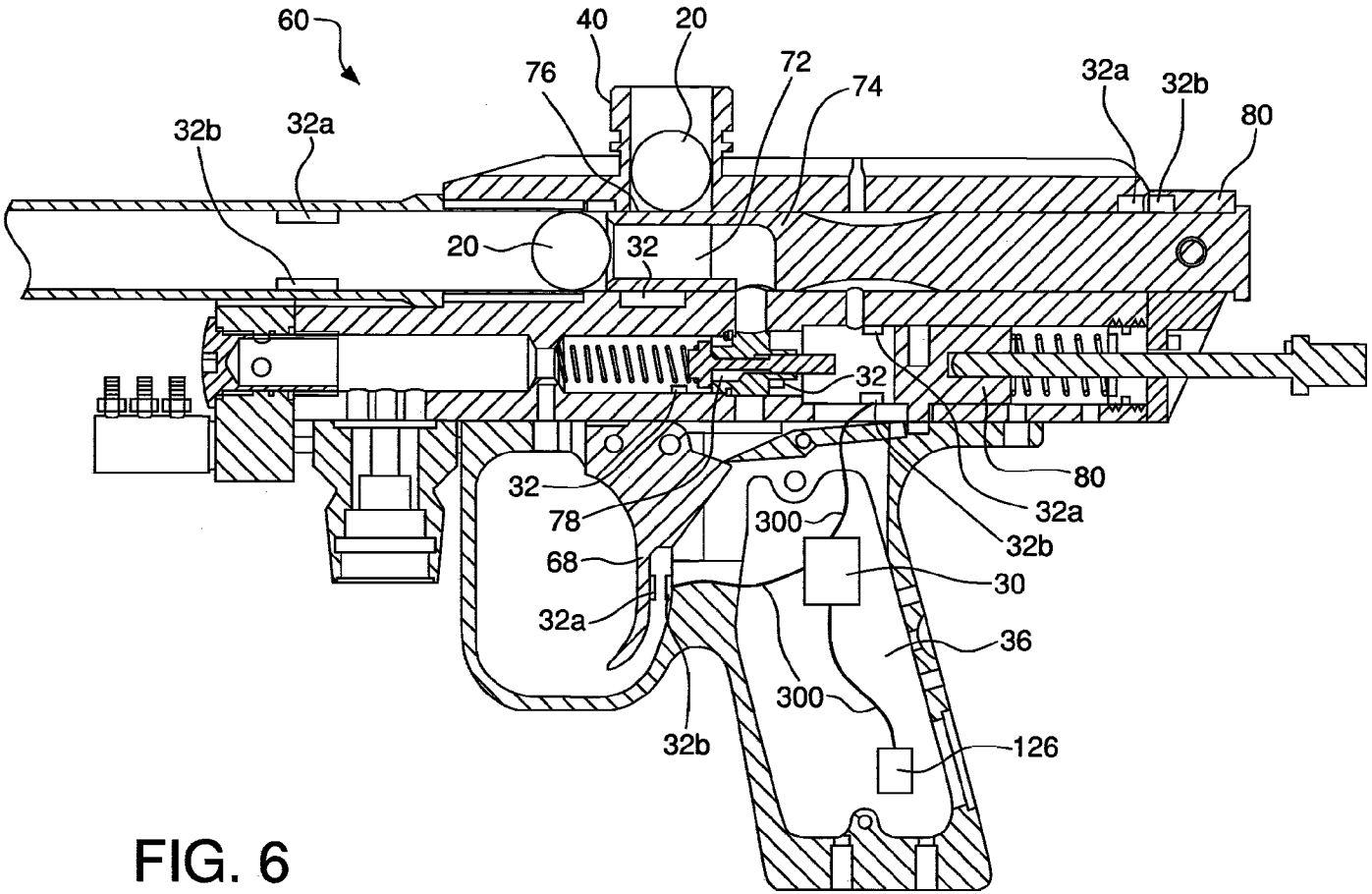
FIG. 6 shows a partial cross-sectional side view of another type of illustrative paintball gun according to the present invention.

A firing operation may further be the movement of at least one of the component parts of a paintball gun 60. For example, a paintball gun 60 may include a moving bolt 74 for chambering a projectile (paintball) during firing. Certain paintball guns have a moving back block 80 for moving the bolt 74, as shown in FIG. 6. Accordingly, a sensor 32 or sensor pair 32*a*/32*b* (such as an emitter and receiver) may be positioned at a location to detect movement of the bolt 74 or back block 80. Many paintball guns 60 are equipped with "anti-chop eyes" which are optical sensors 46 in the firing chamber 72 of the paintball gun used to detect either paintball 20 position, or bolt 74 position, and send signals to paintball marker control circuitry 84 in response to such detection. These same types of sensors, or in fact the very same sensors, may be used as the sensor of the present invention.

Similarly, a sensor 32 or sensor pair 32*a*/32*b* may be positioned to detect the movement of the trigger 68 of the paintball gun 60. Any sensor or sensor pair can be positioned at any location on, about, or in a paintball gun 60 where movement of any moving parts (bolt, valve, trigger, back block, etc.) that move during or as a result of a firing operation are within the scope of the present invention. The sensor 32 should, therefore, be any type of sensor that can detect any aspect of a firing operation. As previously discussed, electromechanical sensors, infrared (IR) sensors, contact pads, optical sensors, sound sensors, shock sensors, piezoelectric sensors, or any similar such sensors may be used. The sensor 32 may be an electromechanical switch, an optical sensor, an infrared (IR) sensor, a piezoelectric sensor, a pressure sensor, a shock sensor, an accelerometer, etc.

The sensor 32 may also be positioned anywhere on, about, or in proximity to the paintball gun 60, and may be positioned and adapted to detect any detectable firing events, such as, for example, movement of any of the moving parts of the paintball gun 60 (such as the trigger, springs, valve parts, or the bolt), initiation of a firing operation, the sound of the paintball gun firing, the pressure or shock wave generated by a paintball gun when firing, the movement of a projectile 20 within the paintball gun, changes in spring tension on any parts of the paintball gun, movement of any valves, or any other detectable event taking place in connection with a firing operation of the paintball gun 60.

Other examples of sensor 32 arrangements that may be used is shown in U.S. Pat. Nos. 5,947,100 and 5,791,325, the entire contents of which are incorporated by reference. U.S. Pat. No. 5,791,325 utilizes a magnet sensor pair 32*a*, 32*b*, to detect a firing operation. As described in U.S. Pat. No. 5,947,100, a firing operation sensor 32 which uses sound, pressure variations or shock waves to sense a gun firing operation may be used. The sensor may be a microphone, however, it will be recognized by those familiar with the sound detection art that the sensor may encompass any type of device which is capable of converting sound movement, or shock waves into detectable electrical changes. A microphone, other wave detector types of devices such as pressure sensors or shock sensors could also be used, and the waves do not have to be transmitted solely through the air, but instead may be transmitted through the materials of the paintball marker gun.

FIG. 2 is a signal diagram 505 of a firing and loading sequence performed by the wireless communication system 100 of the present invention. The sensor 32, upon sensing or detecting a firing event or operation (510), generates a signal indicating that the paintball loader motor 44 should operate thereby notifying the transmitter 34 of a firing operation, which may be referred to as the "demand signal," as the firing operation indicates a demand for projectiles to be fed to the paintball gun 60.

The sensor 32 then communicates that detection to the wireless transmitter 30 (520). The transmitter 30 receives the demand signal from the sensor 32 and transmits a signal herein referred to as a "loader operation signal" (530) to the receiver 34 via the antenna 37.

The receiver 34 receives the loader operation signal from its antenna 39 and notifies the controller 36 of the loader operation signal (540). Upon receiving the loader operator signal, the controller 36 operates the motor 44 (550) to load another projectile into the paintball gun.

In one preferred embodiment of the present invention, upon receiving the loader operation signal, the receiver 34 will operate a motor 44, whereby the motor will either operate an agitator 22 to agitate paintballs (in a gravity feed style loader), or operate a feed mechanism 28 or drive cone to force paintballs into the outfeed tube 16 (in an active feed style loader). In many known paintball loaders, the motor turns a drive shaft 24, which rotates an agitator 22 or an active feed mechanism 28. When the loader operation signal ceases to be transmitted, the motor may either immediately stop, or may stop after a preselected time.

As previously described, at least one controller 36 may be provided, such as an electronic or electrical circuit or circuitry, which may include at least one microprocessor 38, to control and/or process the various detection and transmission events of the wireless system 100. For example, the controller 36 may control the loader operation signal, receive the signal from the receiver of the paintball loader 10, operate the motor, or otherwise control the transmissions, signals, elements and features of the system.

Alternatively, a controller 36 may be provided, for example, in communication to the sensor 32, transmitter 30, receiver 34, loading mechanism 44, or any combination of those elements. The controller 36 may also be used to control various aspects of the paintball gun 60 operation. At least one power source 42, such as a battery, is provided for supplying power to the wireless paintball loader system of the present invention. Generally, at least one battery 126 will be positioned in or about the paintball gun 60, and at least one battery 126 will be positioned in the paintball loader 10. At least one or a plurality of ON/OFF switch may be provided for control of power by a user.

A paintball loader 10 of the present invention accordingly includes a wireless receiver, or detector, 34 which is used to detect the firing operation signal from the wireless transmitter 30. As described, the wireless receiver 34 is in operative communication with the controller 36 for the motor 44 of the paintball loader 10. Upon receiving a signal from the wireless transmitter 30 that a firing operation has occurred or is occurring, the wireless receiver 34 will proceed to operate the loading mechanism 44 to, in turn, operate the agitator 22 or feed mechanism 28 of a paintball loader, and thereby either mix paintballs to prevents jams (in an agitating gravity feed loader), or to operate the feed mechanism to force paintball to the outfeed tube (in an active feed paintball loader).

A switch 61 may be provided on or about the paintball gun and/or the paintball loader, between the power source and the wireless communication system 100, for activating/deactivating the wireless communication system 100.

The components of the paintball gun 60 such as the sensor 32, transmitter 30, controller 26, microprocessor 38, and battery 126 may be in electrical communication with each other, such as through suitable electrical connections such as wires, represented schematically in FIGS. 1-2, 10-11. Similarly, the components of the paintball loader 10 such as the receiver 34, controller 36, motor 44, and battery 26, may be in electrical communication with each other, such as through suitable electrical connections such as wires, represented schematically in FIGS. 1-2, 10-11. Alternately, these components may be in communication through wireless connections. Representative lines 300 illustrate schematically suitable electrical connections. Such connections may run through, on or about the body 62 of the paintball gun 60, and similarly through, on or about the body 12 of the loader 10.

It can therefore be seen that the wireless system of the present invention produces an efficient and effective system whereby a wireless signal is utilized to operate a paintball loader in response to the firing operation of a paintball gun.

The wireless system of the present invention may utilize Radio Frequency Identification (RFID) tags (or chips) as components of the controller 36, wireless transmitter 30, the wireless receiver 34, or any combination of those, for transmitting or receiving the various signals, or for controlling loader operation.

Figure 10:
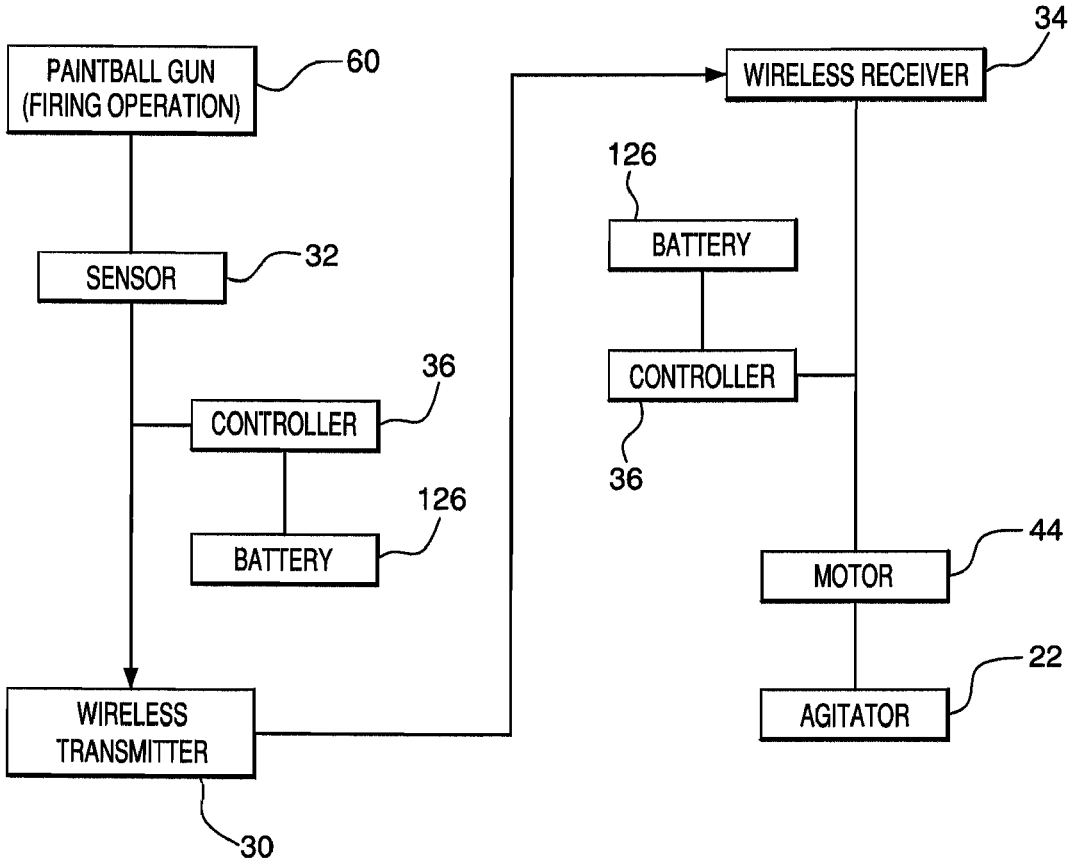
FIG. 10 is a functional block diagram of a wireless system configured to load a projectile, in accordance with the present invention.
Figure 11:
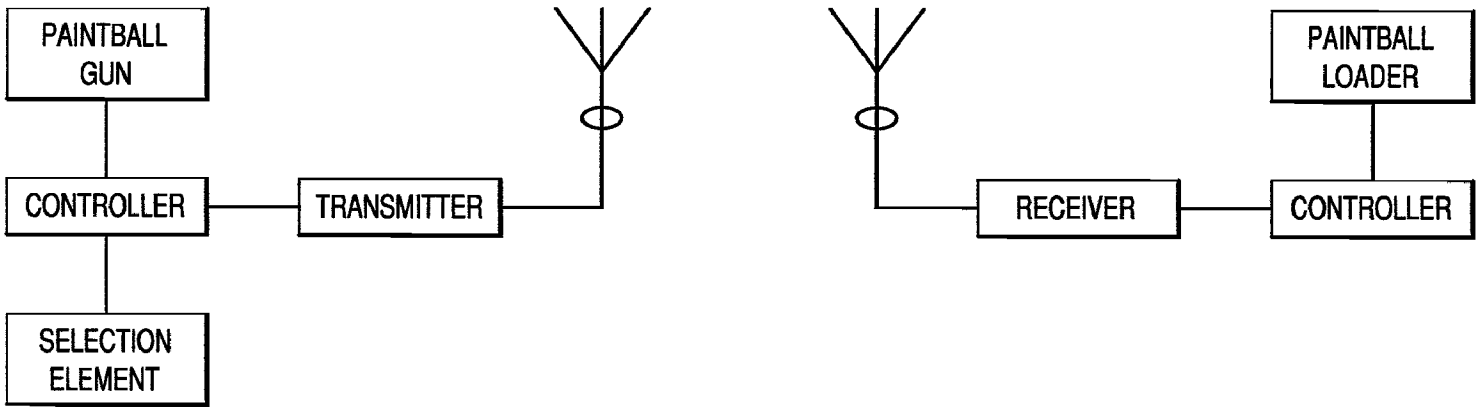
FIG. 11 is a functional block diagram of a wireless system configured to control operation of a projectile loader, in accordance with the present invention.

An embodiment of the operation of the wireless system 100 of the present invention will now be described, and is schematically represented in FIG. 10. The sensor 32/transmitter 30 and the receiver 34 and motor 44 of the paintball loader 10 are powered on. Since the paintball marker 60 has not been fired, the motor 44 of the paintball loader 10 is not yet operating. A user pulls the trigger 68 of the paintball gun 60, which triggers firing operation 102 schematically represented in FIG. 10.

An aspect of the firing operation 102 is detected by the sensor 32 positioned somewhere about the paintball gun 60. The sensor 32 sends a demand signal to the wireless transmitter 30.

The wireless transmitter 30 sends a loader operation signal 104 to the receiver 34 of the paintball loader 10. Upon receiving the loader operation signal 104, the receiver 34 will send a signal to turn the motor 44 on. The motor 44 will operate the drive shaft 24, thereby operating the agitator 22 or feed mechanism 28. This will mix paintballs 20, or forcibly feed paintballs 20 to the paintball gun 60. It is appreciated that the receiver 34 may be in communication with a switch 61 such as a switching circuit or an electrical or electromechanical switch that turns the motor 44 on or off. The receiver 34 is adapted to operate such a switch to operate the motor 44.

Paintball guns 60 often fire in quick succession, producing successive firing operations 102. Therefore, it will be common for several firing bursts to result in several demand signals and loader operation signals. When the paintball gun 60 ceases firing operations 102, the transmitter 30 will cease transmitting a signal. The receiver 34 will not receive a signal, and the motor 44 may shut off.

At least one or a plurality of controllers 36 may be in communication with various components of the wireless system 100 of the present invention, and may control, process, monitor and/or regulate various aspects of operation of the wireless system 100 of the present invention. For example, the controller 36 may process either or both of the transmission and loader operation signals. The controller 36 may be used to control the motor 44, such as by having the motor 44 run for a certain amount of time after the receiver ceases to receive a signal from the transmitter. For example, it may be desirable for the motor 44 to run for two seconds after the loader operation signal ceases to be transmitted. The controller 36 will control this function.

The controller 36 may also or alternately be equipped with various user controls 46 such as touch pads or switches for controlling the operation of the wireless system 100 or various parameters of operation, such as the sensitivity of the sensor 32, the duration or strength of a firing operation in order to be detected by the sensor 32, the direction of rotation of the motor 44, the speed of the motor 44, the length or duration of the loader operation signal, the frequency at which the transmitter transmits a wireless signal, etc.

It is appreciated that components of the wireless system 100 of the present invention can be offered as, for example, an "after market" kit, so that a paintball sport player can modify an existing loader to become a wireless loader. Thus, a kit including a sensor 32, transmitter 30, and receiver 34 may be offered as an upgrade to an existing, non-wireless paintball gun and paintball loader.

Figure 12:
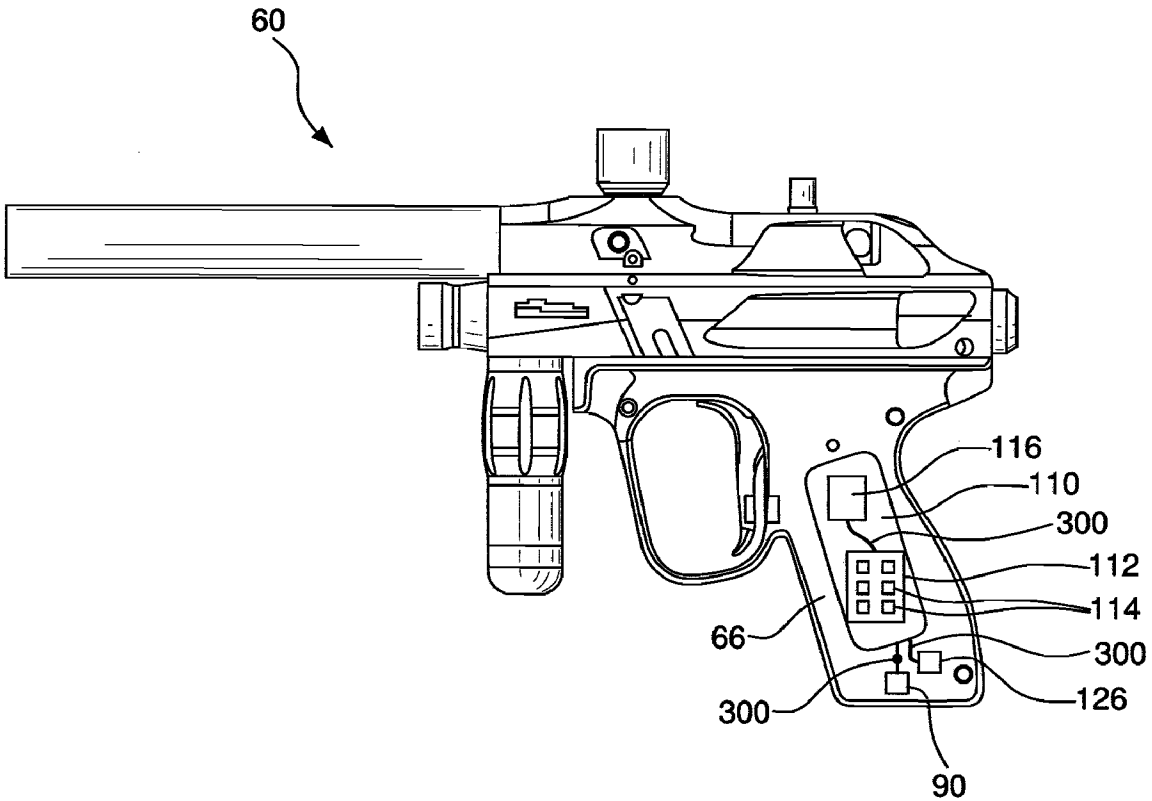
FIG. 12 is a side view of a paintball gun according to an embodiment of the present invention.

In another embodiment of the present invention, a paintball gun 60 includes a controller 110, which can be an electronic control circuit, circuit board, or logic circuit, etc., and may include a microprocessor 112. The controller 110 include at least one user-actuated selection element 114 such as one or a plurality of buttons, switches, touch pads, toggles switches, etc. The selection elements 114 are preferably positioned for easy access by the user of a paintball gun 60, such as on or about the grip 66. The controller 110 is in operable communication with a wireless transmitter 116, such as a wireless transmitter previously described herein, as shown in FIG. 12. The controller 110 is in communication with a battery 126, and a power switch 90 may be provided for controlling power to the controller 110.

Figure 13:
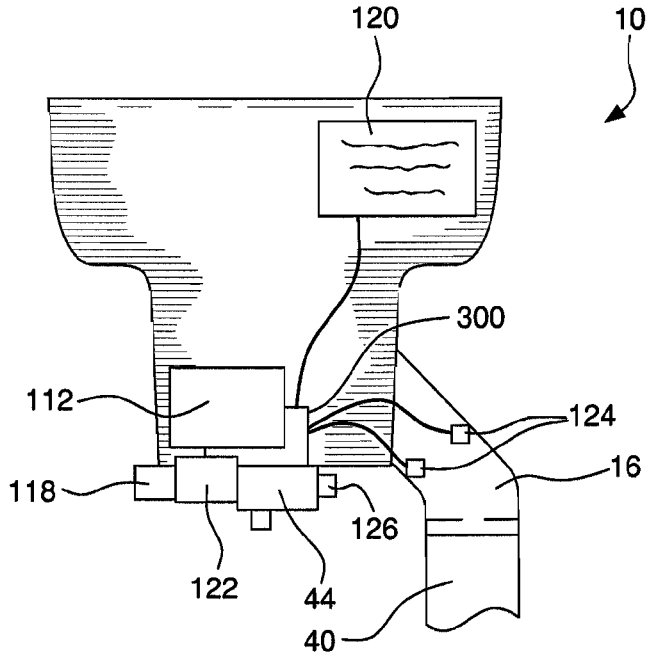
FIG. 13 is a side view of a projectile loader according to an embodiment of the present invention.

A paintball loader 10 includes a wireless receiver 118 for receiving a signal from the wireless transmitter 116. The paintball loader 10 has several user-selectable operation parameters, such as the speed or power of the motor, the direction of rotation that the motor operates the drive shaft, selecting a variable speed for the motor, the length of time the motor runs after receiving a signal to operate or ceasing to receive a signal to operate, the sensitivity of any sensors, etc. The paintball loader may further include a display 120 (such as an LCD or LED display or any similar or equivalent display) for displaying parameters of the paintball loader operation, such as shot count, elapsed game time, paintball usage, battery life, remaining paintballs in the loader, etc. The paintball loader may include at least one or various sensors 124 for detecting paintball absence, presence or movement, agitator 22 movement or operation, motor 44 movement or operation, battery drain, etc. The paintball loader 10 further comprises a controller 122, controller 110, which can be an electronic control circuit, circuit board, or logic circuit, etc., and may include a microprocessor 112, as shown in FIG. 13. The controller 110 may be in communication with a battery 126, the motor 44, the display 120, the sensors 124, and any other paintball loader components that may be monitored or operated.

The controller 110 may be adapted to control the operation of the parameters of the paintball loader 10. Presently, it is known to have a controller in the grip of a paintball gun for controlling operation of the paintball gun such as in, for example, paintball guns sold under the brands RACEGUN™, and INDIAN CREEK DESIGNS™. The electronic controllers in these paintball guns control various user-selectable parameters such as firing modes, charging cycle, shot count, CO2 usage, etc., and are well known in the art.

The controller 110 according to the present invention is adapted to send a wireless signal from the paintball gun 60 transmitter 116 to the receiver 118, in response to a user setting the user-selectable parameters of operation using the buttons for setting the controller 110. This is shown schematically in FIG. 11. Accordingly, a user may set or select a parameter (200) for operation of the paintball loader 10 using the selection elements 114 that are in communication with (or an integral part of) the controller 110. The controller 110 sends a control signal (202) to the wireless transmitter 116. The wireless transmitter 116 sends a control signal (204) to the wireless receiver 118 of the paintball loader that is in communication with the controller 122 of the paintball loader 10. In response to receiving the control signal (204), the controller 110 will control, set, change, modify, etc., the paintball loader operation parameter based on the user's selections.

For example, the user may wish to see how many paintballs have been used. By using the buttons 114, the user my select this parameter for display on the display 120 of the paintball loader 10. The controller 110 will cause the wireless transmitter 116 to send a wireless signal to the wireless receiver 118. The wireless receiver 118 will communicate the signal to the controller 122 of the paintball loader 10. The controller 122 will send the appropriate signal to the display 120 to display how many paintballs 20 have been used by the loader, which information was collected by the appropriate sensor 124 and collected by the controller 122 and stored on the circuitry or memory of the controller 122.

Any paintball loader operation parameter, such as any variable in connection with battery power (such as switching power ON/OFF, or monitoring or reviewing the power left in the batteries), motor operation (ON/OFF, speed, length of operation, force of operation, direction of operation), sensor operation, projectile count, projectile usage, game time, elapsed time, etc., can be controlled, operated and/or monitored wirelessly in this manner.

According to the present invention, the operation of the motor 44 of a paintball loader 44 in response to a firing operation is considered to be a paintball loader operation parameter. Activating a sensor or controller of a paintball gun to detect a firing operation (such as when a user powers on a sensor, controller and/or transmitter of the paintball gun) is considered to be selecting a paintball loader operation parameter, as whether to not to agitate or supply paintballs to the paintball gun in response to the demand of the paintball gun is considered to be a paintball loader operation parameter.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A wireless projectile loader system, comprising:

a compressed gas gun, the compressed gas gun comprising:

at least one sensor for detecting a firing operation of the compressed gas gun occurring before a projectile is fired from the gun and sending a sensor signal; and, a wireless transmitter in communication with the at least one sensor, the wireless transmitter adapted to receive the sensor signal and send a wireless signal in response to the sensor detecting a firing operation of the compressed gas gun occurring before a projectile is fired from the gun; and, a projectile loader, comprising:

an agitator;

a motor for operating the agitator;

at least one wireless receiver in communication with the motor adapted to receive the wireless signal.

2. The wireless projectile loader system according to claim 1, further comprising a controller in communication with the receiver for operating the motor.

3. The wireless projectile loader system according to claim 2, wherein the controller further comprises a microprocessor.

4. A wireless projectile loader system, comprising:

at least one sensor for detecting a firing operation of a compressed gas gun occurring before a projectile is fired from the gun and sending a sensor signal; and, a wireless transmitter in communication with the at least one sensor, the wireless transmitter adapted to receive the sensor signal and send a wireless signal in response to the sensor detecting a firing operation; and, at least one wireless receiver for receiving the wireless signal, the receiver being in communication with a motor of a projectile loader and adapted to initiate operation of the motor in response to the wireless signal transmitted by the transmitter.

5. The wireless projectile loader system according to claim 4, further comprising a controller in communication with one of the transmitter and the receiver.

6. The wireless projectile loader system according to claim 5, wherein the controller further comprises a microprocessor.

7. A method of wirelessly operating a projectile loader, the method comprising the steps of:

(a) detecting a firing operation of a compressed gas gun occurring before a projectile is fired from the gun;

(b) wirelessly transmitting a signal in response to the firing operation;

(c) receiving the signal; and, (d) operating a motor of the projectile loader.

8. A method of wirelessly operating a projectile loader, the method comprising the steps of:

(a) providing a compressed gas gun comprising at least one sensor and at least one wireless transmitter in communication with the at least one sensor;

(b) providing a projectile loader comprising a motor and at least one wireless receiver in communication with the motor;

(c) detecting a firing operation of the compressed gas gun with the sensor, the firing operation occurring before a projectile is fired from the gun;

(d) transmitting a demand signal from the sensor to the wireless transmitter;

(e) wirelessly transmitting a loader operation signal from the wireless transmitter to the wireless receiver;

(f) operating the motor in response to the loader operation signal.

9. A wireless system for controlling operation of a projectile loader, comprising:

a compressed gas gun including a controller associated with the gun, and a wireless transmitter in communication with the controller, the transmitter sending a signal upon detection of a firing operation of the gun occurring prior to a projectile being fired from the gun;

a projectile loader including a receiver for receiver wireless signals from the wireless transmitter, and a controller associated with the projectile loader for controlling an operation of the projectile loader.

10. The wireless system of claim 9, further comprising at least one user-actuated selection element in communication with the controller that is associated with the gun.

11. A method of controlling operation of a projectile loader, comprising the steps of:

(a) selecting a projectile loader operation parameter;

(b) wirelessly transmitting a signal in response to the selection;

(c) receiving the signal; and, (d) controlling the operation of the projectile loader in response to the signal.

12. A method of controlling operation of a projectile loader, comprising the steps of:

(a) wirelessly transmitting a signal representing a projectile loader operation parameter;

(b) receiving the signal; and, (c) controlling the operation of the projectile loader in response to the signal.

13. The method of claim 12, further comprising the step of selecting a projectile loader operation parameter, prior to step (a).

14. A method of operating a paintball device comprising a paintball marker which wirelessly transmits a signal to a paintball loading device responsive to the initiation of the marker's firing sequence; the loader receives the signal from the marker and processes the transmission; an electronic circuitry of the loader directly or indirectly sends a signal to an electric motor of the loader; the electric motor rotates to load paintballs into the marker.

15. The method of claim 14 whereby initiation of the process is by mechanical, electronic, or human means.

16. The method of claim 14 whereby wireless signal initiation is from a transmitting device wired among the circuitry of the paintball marker.

* * * * *

UNITED STATES PATENT AND TRADEMARK OFFICE

CERTIFICATE OF CORRECTION

PATENT NO. : 7,921,835 B2
APPLICATION NO. : 11/522071
DATED : April 12, 2011
INVENTOR(S) : Campo et al.

It is certified that error appears in the above-identified patent and that said Letters Patent is hereby corrected as shown below:

IN THE CLAIMS:

Claim 9, column 12, line 3, the second occurrence of "receiver" should be changed to -- receiving --.

Signed and Sealed this
Sixteenth Day of August, 2011

David J. Kappos

David J. Kappos
*Director of the United States Patent and Trademark Office*